United States Patent [19]

Bogner

[11] Patent Number: 4,518,969

[45] Date of Patent: May 21, 1985

[54] VERTICALLY POLARIZED OMNIDIRECTIONAL ANTENNA

[75] Inventor: Richard D. Bogner, Roslyn, N.Y.

[73] Assignee: Leonard H. King, Valley Stream, N.Y.

[21] Appl. No.: 452,397

[22] Filed: Dec. 22, 1982

[51] Int. Cl.[3] ..... H01Q 19/30; H01Q 19/10

[52] U.S. Cl. ..... 343/819; 343/821; 343/836

[58] Field of Search ..... 343/833–838, 343/819, 821

[56] References Cited

U.S. PATENT DOCUMENTS

| | | | |
|---|---|---|---|
| 3,936,835 | 2/1976 | Phelan | 343/833 |
| 4,021,815 | 5/1977 | Bogner | 343/836 |
| 4,240,080 | 12/1980 | Woodward | 343/836 |

*Primary Examiner*—Eli Lieberman

*Attorney, Agent, or Firm*—Leonard H. King

[57] ABSTRACT

An antenna for providing a vertically polarized omnidirectional horizontal radiation pattern comprising colinear dipoles. Suitable feeding arrangements are provided for electromagnetically feeding the dipoles with a signal. An axially extending conductive member is spaced on either side of the colinear dipoles. The axis of each of said conductive members as well as the axis of the dipoles are colinear and parallel.

26 Claims, 6 Drawing Figures

FIG. 1
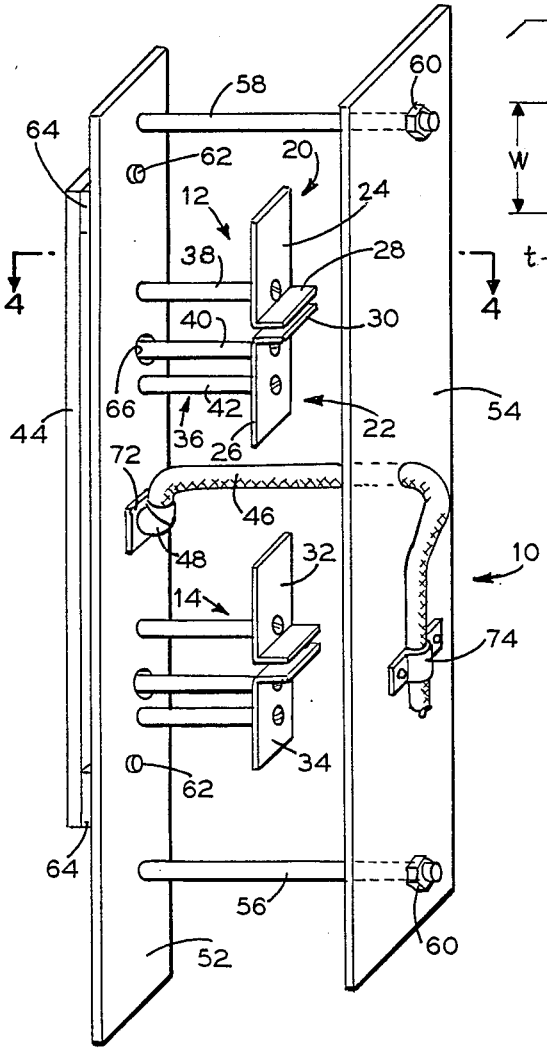
FIG. 4
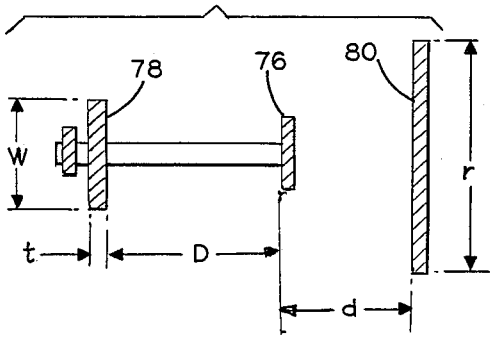
FIG. 5
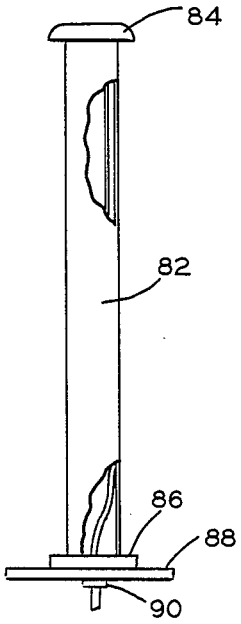
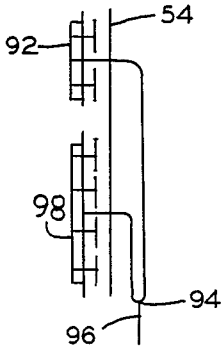
FIG. 6

VERTICALLY POLARIZED OMNIDIRECTIONAL ANTENNA

BACKGROUND OF THE INVENTION

This invention relates to antennas and more particularly to a vertically polarized omnidirectional antenna.

In various antenna requirements, there is need for an omnidirectional antenna of relatively high gain. Specifically, in the field of vehicular communication, there is needed a vertically polarized omnidirectional antenna of relatively high gain. One method of providing this requirement is to utilize a vertical array of colinear dipoles. Typically, colinear cylindrical dipoles are employed which are centrally fed by a coaxial transmission line. Such a vertical array provides the necessary vertical polarization and produces an omnidirectional pattern in the horizontal plane.

Another prior art solution to providing this requirement is to utilize vertical dipoles which are mounted a considerable distance from a vertical support member which member contains the transmission lines which feed the dipoles. Typically, at least several wavelengths distance are required between the dipoles and the vertical support to provide omnidirectional coverage, or alternatively several dipoles are required at each level.

Each of the prior art proposed solutions have limitation. For example, utilizing a vertical array of colinear dipoles is quite complex and operates well over only a narrow frequency band. Also, it is limited in power handling, in maximum obtainable gain, and in obtaining beam downtilt and null fill-in in the vertical plane. On the other hand, utilizing vertical dipoles which are side mounted require large size and also may depart from the designed omnidirectional horizontal coverage.

SUMMARY OF THE INVENTION

The present invention provides for a simple design which produces a vertically polarized omnidirectional antenna and is a design which avoids the aforementioned problems of prior art devices. Specifically, it combines the simplicity and vertical plane pattern control of the offset mounted dipoles and at the same time gives the benefit of small cross section and good omnidirectionality which is usually produced by the colinear dipoles.

It is well known that if one were to take a single long conductive member and place it parallel and close to a vertically oriented dipole, the long conductive member will cause a severe departure from the normal omnidirectional radiation pattern emitted from the dipole in the horizontal plane. The conductive member would be parallel to the radiated electric vector of the dipole and in the limit cause a null in the radiation pattern. This null appears in the direction from the dipole toward the conductive member.

What has now been discovered, is that by adding a second conductive member close to the dipole, on the opposite side thereof and parallel to a first conductive member as well as the dipole, an unusual and unexpected result occurs. It would be expected that just as the first conductive member produced a null in the direction from the dipole toward the first conductive member, the second conductive member would similarly produce a null between the dipole and the second conductive member. However, it has been unexpectedly found that the proper combination of spacing and conductive members results in elimination of all nulls, and instead, actually produces omnidirectional radiation patterns. Further, one or both conductive members can be used to hold the feeding for the dipoles.

Accordingly, there can be provided a simple design for a vertically polarized omnidirectional antenna comprised of a vertical dipole which is positioned between and closely spaced between, two vertical conductive members, one on either side of the dipole such that the axes of all the three members are coplanar and parallel. The vertical dipole can be fed from any well known feeding device such as coaxial cable, strip line, etc. Preferably, the feed lines should be electrically hidden to avoid reflection off these feeding lines. Conveniently, the feeding lines can be hidden behind one or both of the conductive members themselves so that they no longer interfere with the radiation pattern.

A number of vertical dipoles can be arranged colinearly and combined into units or bays with each bay mounted within a particular housing. These can then be combined as needed utilizing well known matching tees, with beam downtilt and null fill-in provided by varying phase and/or amplitude among the bays.

Accordingly, it is an object of the present invention to provide a vertically polarized omnidirectional antenna which improves over prior art designs.

Another object of the present invention is to provide a vertically polarized omnidirectional antenna utilizing at least one vertical dipole with a conductive member spaced on either side of the dipole with the conductive members and dipole being coplanar and parallel.

A further object of the present invention is to provide a vertically polarized omnidirectional antenna of small cross-section which is simple in design, easy to feed, provides sufficient power handling and maximum gain, is easy to construct and control, and provides beam down-tilt and null fill-in over a large frequency band.

The aforementioned objects, features and advantages of the invention will, in part, be pointed out with particularity and will, in part, become obvious from the following more detailed description of the invention, taken in conjunction with the accompanying drawings, which form an integral part thereof.

BRIEF DESCRIPTION OF THE DRAWINGS

In the drawings:

FIG. 1 is a perspective view of an embodiment of the vertically polarized omnidirectional antenna in accordance with the present invention;

FIG. 4 is a cross sectional view taken along lines 4—4 of FIG. 1 and showing the specific operational distances involved in the antenna;

FIG. 5 is a side view of an antenna mounted within a housing in accordance with the present invention, and FIG. 6 is a schematic view showing a plurality of modules of antennas interconnected to form an antenna array.

In the various figures of the drawing, like reference characters designate like parts.

DESCRIPTION OF THE PREFERRED EMBODIMENTS

Figure 2:
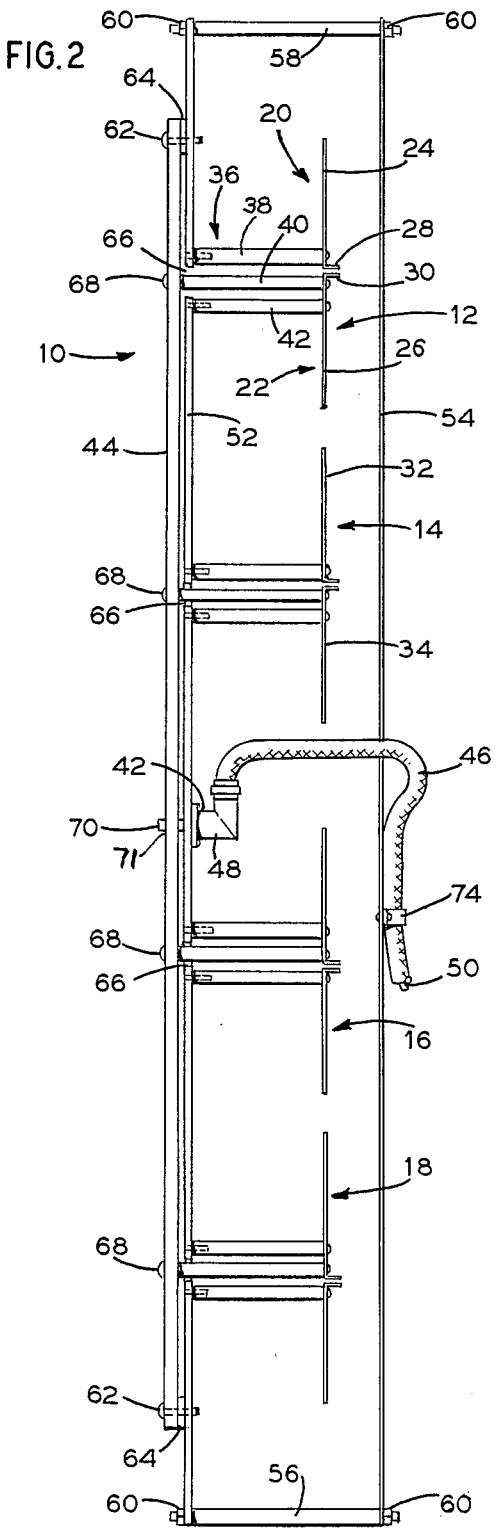
FIG. 2 is a side elevational view of an antenna in accordance with the present invention having a plurality of dipoles.
Figure 3:
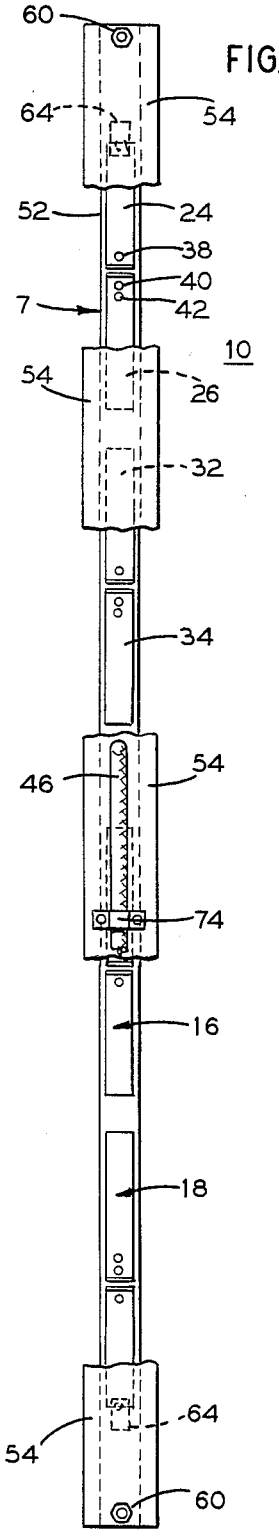
FIG. 3 is a front elevational view of the antenna shown in FIG. 2 with the front conductive member being cut away in part.

Referring now to FIGS. 1–3, there is shown an embodiment of a vertically polarized omnidirectional antenna shown generally at 10 and formed by a plurality of vertical dipoles 12, 14, 16 and 18. By way of example, the embodiment of FIG. 1 shows two dipoles 12 and 14, while the embodiment shown in FIGS. 2 and 3 each show an array of four dipoles. It should be appreciated, that any number of dipoles can be utilized.

Although any particular vertical dipole can be utilized, in the embodiment shown the dipoles are formed of opposing arms 20, 22 each having a respective arm section 24, 26 and a respective upturned horizontal sections 28, 30. The sections 28, 30 provide impedance matching means. Other matching means may be employed such as conductively connecting members 40 and 42 at points other than at arm 30 only. The arms 24, 26 are coaxially aligned. Similarly, the arm sections 32, 34 of the next adjacent vertical dipole 14 would be likewise colinearly aligned. Thus, all of the vertical dipoles are colinearly positioned along a common axis. The pair of arms should have a total length from tip to tip between 0.2 $\lambda$ and $\lambda$ where $\lambda$ is the wavelength of the frequency of interest.

Referring again to the dipole 12, it will be noted that it is fed by a center feed mechanism, shown generally at 36 and formed by three cylindrical members 38, 40, 42. The members 38, 40, 42 provide for a center feed to the two dipole sections 20, 22 and also provide for suitable impedance matching as well as providing for the necessary transfer from unbalance to balance. Accordingly any classic type of balun can be utilized to provide the necessary transformer action from an unbalanced to a balanced situation.

It will be noted that each of the dipoles 12–18 are similarly provided by the center feed cylindrical members which also provide the necessary balance transformation.

The dipoles are electromagnetically fed, in this example by means of a strip feed mechanism including the strip feed bar 44, the dipoles being about one wavelength apart along the axis. The bar 44 is in turn electrically fed by means of the coaxial cable 46 which is connected to a right angle coaxial coupling section 48. The coaxial feed line 46 has at its opposing end a coupling member 50 which can suitably be coupled to the source of electromagnetic energy.

The strip feed plate 44 serves as one member of a two conductor unbalanced feed with one side of base plate member 52, which also serves as one reflector for the radiation pattern emitted from the colinear dipoles. On the opposing side of the dipoles, there is provided another conductive reflective plate 54. The two conductive reflector plates are shown as conductive plates and are coplanar with each other and parallel with each other and also coplanar and parallel with the axis of the dipole arms. Where the arms of the dipole are not parallel to each other the axis of the dipole shall be deemed to be the feed points of the arms such as the junction of the arms with members 38 and 42.

In order to properly position the opposing conductive plates 52, 54, spacer rods 56, 58 are interposed between the two conductive plates 52, 54 between dipoles. The rods extend through suitably provided openings in the plates 52, 54 and are held in place by means of suitably provided nuts 60. Other types of coupling arrangements could be provided.

Since the strip feed 44 as well as the coaxial cable 46 are electrically conductive, they would normally offer interference to the radiation pattern. Accordingly, they are shown to be electrically positioned to avoid interference with the radiation pattern. Particularly, they are each shown hidden behind a conductive plate 52 and 54. The strip feed plate 44 is shown secured to the outer face of the conductive plate 52. Specifically, they are interconnected by means of the screws 62 which extends into the conductive plate 52, at a point about $\lambda/4$ from the end dipoles. Appropriate spacing members 64 are provided to space the strip feed plate 44 from the outer surface of the conductive member 52. The center rod 40 of the coupling rods 36 extends through an opening 66 in the conductive plate 52 and is coupled and also supports the strip feed by means of the screw 68.

A right angle coaxial connector 48 extends through the plate 52 and couples the coaxial line 50 to the strip feed line. Connector pin 70 of the connector 48 is mechanically and electrically secured to the feed strap 44. Outer conductor of coaxial connector 48 is conventionally provided with a flange 42 which is in turn mechanically and electrically connected to conductive member 52. The feed point 71 at which pin 70 joins the feed bar 44 may be halfway between dipoles which are separated by a distance $\lambda$, where $\lambda$ is a wavelength at the frequency of interest. The frequency of interest being the frequency at which the antenna is to operate. Alternatively, as shown, the feed point 71 may be $\lambda/4$ from one dipole and 3 $\lambda/4$ from the other dipole with the dipoles above and below the feed point reversed. This latter method maintains all dipoles in required equal phase and also improves bandwidth over the center feed method.

A flexible coaxial line 46 is placed between the dipoles and is also electrically hidden by supporting in on the outer surface of the conductive plate 54. Adhesive tape or other suitable holding member 74 can be provided at spaced locations to secure the coaxial cable along the outer surface of the conductive members 54.

As heretofore mentioned, the colinear dipoles would normally produce an omnidirectional pattern. When one conductive member, such as conductive member 52, would be placed alone in its position spaced from the dipoles, it has heretofore been known to provide for a null in the direction connecting the dipole and the conductive member. This would be a severe departure from the omnidirectional radiation pattern. However, when a second conductive member 54 of correct size and position is placed opposing the member 52, the unexpected result is found that rather than causing two nulls as might be expected, an omnidirectional pattern is produced in the plane transverse to the dipole. Although the exact reason is unknown, it is assumed that because of the presence of the conductive members, suitable reflections are produced causing multiple standing wave between the two conductive plates which may cancel the nulls and produce the omnidirectional pattern. However, this is conjecture and regardless of the reason, the unexpected result has been noted.

As a result, it is possible to provide for a vertically polarized omnidirectional antenna as shown. This antenna is beneficial in that it can be easily built and fed with controlled phase and amplitude. At the same time, it provides for a cross section which is minimal and also provides large gain in a broad band of frequencies.

Although the spacing can be somewhat varied, FIG. 4 shows the specific arrangement for best operation. As shown in FIG. 4, the dipole arm 76 is spaced from the first conductive member 78 by a distance "D." The thickness of the conductive member 78 is shown as "t" and it has a width of "w." The spacing of the dipole arm 76 from the other conductive plate 80 is shown as "d." The plate 80 has a width of "r" and a thickness of "v."

It has been found that the values of W, D, d and r, should also be considerably less than a wavelength λ at the midband of the design range. The values of v and t are small fractions of λ. More particularly, D is usually between λ/8 and λ/2; d is between λ/20 and λ/4; r is from a small fraction of λ up to λ/4 and W is from a small fraction of up to λ/2. The dipole itself is generally between λ/4 and λ long in total arms length and usually about λ/2 long overall. A specific embodiment of a vertical omnidirectional antenna of interest was constructed having the values r in the range from 0.12 λ to 0.14 λ at the frequency of interest; d in the range from 0.08 λ to 0.10 λ; D in the range from 0.24 λ to 0.26 λ; and w in the range 0.06 λ to 0.08 λ. Typically, the length of the conductive members should be greater than λ/2 along their respective axes, and preferably the length is many wavelengths.

Although the embodiment shown provided for strip line feed, it should be appreciated that other types could be provided, for example, coaxial feed, or other known methods. Also, although a particular type of dipole has been shown, any type of vertical dipole could be utilized. The antenna heretofore described could be mounted within an electrically non-conductive enclosure, as shown in FIG. 5. Specifically, there is shown a cylindrical filament wound fiberglass radome container 82. An upper closure cap 84 is provided and a lower base plate 86 fits into a flange assembly 88 for mounting the antenna in vertical arrangement. A coupling connector 90, preferably of a coaxial type, is provided to couple to the electromagnetic source of signals of interest.

The particular antenna arrangement can be formed in antenna modules having a specific number of dipoles. For example, there may be provided a 4 dipole module, as shown as 98 in FIG. 6 and in FIGS. 2 and 3. A two dipole module is referred to as 92 in FIG. 6. These individual antenna modules 92 and 98 can then be coupled together by means of proper matching T arrangements 94 to provide for a common feed 96. Instead of two or four dipole modules, 6 or 10 dipole modules could also be utilized, as well as other combinations. It is necessary that coaxial lines to each module run behind common reflector plate 54 to the antenna end (base plate) so they will not interfere.

Accordingly, there has been described a vertically polarized omnidirectional antenna which is formed of a dipole having an arm length of between λ/4 and λ. Feeding arrangements are provided for the dipoles so as to feed them transverse to the arms of the dipole. A first conductive member with an axis parallel to the arms of the dipole is provided and which is generally longer than λ/2 along its axis and having a dimension less than λ/2 in a plane transverse to the axis. A transmission line is suitably associated with the first conductive member running parallel along to the axis of the first conductive member and is connected to feed the dipoles. A second conductive member also is provided, with an axis parallel to the dipole arm, and is also of a length greater than λ/2 along its respective axis. The unexpected result is to provide for an omnidirectional pattern from the antennas.

Although the conductive members forming the dipole arms are shown as thin, rectangular plates, other arrangements could also be utilized. For example, one or both of the plates could be circular in cross section, triangular in cross section, or other configurations. Nevertheless, the same result of the omnidirectional signal would be produced. It is to be understood that the arms of the dipole need not be colinear. For example, they may be arranged as a "Vee" or "Fan" extending from the feed point in any orientation. The dipole elements may be cylindrical rods, triangular plates or other electrically equivalent shapes. Such forms of dipoles are shown for example in Chapter 24 of the *Antenna Engineering Handbook*, Henry Jasik, Editor, FIRST EDITION 1961.

There has been disclosed heretofore the best embodiments of the invention presently contemplated. However, it is to be understood that various changes and modifications may be made thereto without departing from the spirit of the invention. It is further understood that the antenna of the invention can be used for transmitting or receiving electromagnetic energy.

I claim:

1. An antenna for producing an omnidirectional radiation pattern comprising:

at least one dipole having a pair of electrically conductive arms extending oppositely along a common axis from a feed point;

feeding means connected to said feed point for coupling said dipole to a signal source of a wavelength λ where λ is the wavelength of interest;

and a pair of opposing axially extending electrically conductive reflecting members spaced apart on opposite sides of said dipole, said members having a width of less than λ/4 transverse to the axis of the dipole, the respective axis of each of said conductive members and said dipole arms being coplanar and parallel;

whereby the polarization of the antenna is transverse to the plane of omnidirectionality.

2. The antenna of claim 1 wherein said dipole has a length between 0.2 λ and λ.

3. The antenna of claim 1 wherein said dipole has a length of about λ/2.

4. An antenna as in claim 1, wherein said dipole axis is oriented vertically relative to the earth's surface to provide a vertically polarized antenna which has an omnidirectional radiation pattern in a plane parallel to the earth's surface.

5. An omnidirectional antenna as in claim 1, comprising a vertical array of a plurality of said dipoles, coaxially aligned, said conductive members being elongated and serving as common reflectors for all of said dipoles.

6. An omnidirectional antenna as in claim 1, wherein said feeding means are electrically hidden by said conductive reflective members.

7. An omnidirectional antenna as in claim 1, wherein said dipole is spaced less than λ from one conductive reflective member.

8. An omnidirectional antenna as in claim 1, wherein the thickness of said conductive reflective members are a small fraction of λ.

9. An omnidirectional antenna as in claim 1, wherein said dipole is spaced between λ/8 and λ/2 from said one conductive member, and between λ/20 and λ/4 from the other conductive member.

10. An omnidirectional antenna as in claim 1, wherein the dipole length is between λ/4 and λ.

11. An omnidirectional antenna as in claim 1, wherein the width of said one conductive member is between 0.06 and 0.08 λ, the width of said other conductive member is between 0.12 λ and 0.14 λ, the distance of the dipole arms to said one conductive member is between 0.24 λ, and 0.26 λ, and the distance to said other conductive member is between 0.08 λ and 0.10 λ, where λ is the wavelength of interest.

12. An omnidirectional antenna as in claim 1, wherein the length of the dipole arm is between 0.2 λ and 0.3 λ.

13. An omnidirectional antenna as in claim 5, wherein said dipole arms are supported by one of said conductive members by support means transversely positioned between said dipole arms and said one conductive member, and wherein said support means also provides for a center feed for said dipoles.

14. An omnidirectional antenna as in claim 13, and comprising a strip line coupled onto said one conductive member for supplying said support means and a coaxial feed line coupled to said strip line for supplying said strip line, said coaxial feed line extending along said other conductive member.

15. An omnidirectional antenna as in claim 7, wherein the length of said conductive members along said axes is greater than λ/2.

16. An omnidirectional antenna as in claim 13, comprising a tubular electrically non-conductive housing member encasing said antenna.

17. An omnidirectional antenna wherein a plurality of dipoles as in claim 1 are electromagnetically coupled to form a module and means for interconnecting at least two of said modules.

18. An omnidirectional antenna comprising a plurality of dipoles as in claim 12 coupled at one wavelength spacing, center-to-center, between adjacent dipoles to form a module.

19. An antenna comprising a plurality of the said modules of claim 18 coupled together.

20. An omnidirectional antenna comprising a plurality of the antennas of claim 1, wherein the dipoles have a length of λ/2, and wherein the width of said one conductive member is between 0.06 λ and 0.08 λ, the width of the said other conductive members is between 0.12 λ and 0.14 λ, the distance of the dipole arms to said one conductive member is between 0.24 λ and 0.26 λ and the distance to said other conductive member is between 0.08 λ and 0.10 λ where λ is the wavelength of interest.

21. The antenna as in claim 20, wherein the width of said one conductive member is about 0.07 λ, the width of said other conductive member is about 0.13 λ, the distance of the dipole arms to said one conductive member is about 0.25 λ and the distance to said other conductive member is about 0.09 λ.

22. A colinear antenna array comprising a plurality of modules electrically coupled together by means of transmission lines, each of said modules comprising a plurality of dipoles including a pair of oppositely extending arms, each of said dipoles having a length of between 0.2 λ and λ, said dipoles of each said modules being fed by means of an open strip line and including a pair of opposing axially extending electrically conductive reflecting members having a width less than λ/4 spaced apart on opposite sides of said modules, the respective axis of each of said conductive members and said dipole arms being coplanar and parallel; where λ is the wavelength of signals of interest.

23. The array of claim 22 wherein said transmission lines used for coupling said modules are electrically hidden by said electrically conductive reflective members.

24. The array of claim 22, wherein said dipoles are spaced less than λ from one conductive reflective member.

25. The array of claim 22, wherein the thickness of said conductive reflective members are a small fraction of λ.

26. The array of claim 22, wherein said dipoles are spaced between λ/8 and λ/2 from said one said conductive member, and between λ/20 and λ/7 from the said other conductive member.

* * * * *